US011237507B2

(12) United States Patent
Watanabe

(10) Patent No.: US 11,237,507 B2
(45) Date of Patent: Feb. 1, 2022

(54) FIXING DEVICE AND IMAGE FORMING APPARATUS

(71) Applicant: Natsuki Watanabe, Kanagawa (JP)

(72) Inventor: Natsuki Watanabe, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 17/073,554

(22) Filed: Oct. 19, 2020

(65) Prior Publication Data

US 2021/0165349 A1 Jun. 3, 2021

(30) Foreign Application Priority Data

Nov. 29, 2019 (JP) ..... JP2019-216861

(51) Int. Cl.
*G03G 15/20* (2006.01)

(52) U.S. Cl.
CPC ..... *G03G 15/2053* (2013.01)

(58) Field of Classification Search
CPC ..... G03G 15/2017; G03G 15/2053; G03G 2215/2003
See application file for complete search history.

(56) References Cited

U.S. PATENT DOCUMENTS

2013/0209125 A1 8/2013 Uchitani et al.
2014/0016972 A1* 1/2014 Seshita ..... G03G 15/2053 399/329
2017/0248879 A1 8/2017 Ishigaya et al.
2019/0377286 A1 12/2019 Naitoh et al.
2020/0033764 A1 1/2020 Kajiyama et al.

FOREIGN PATENT DOCUMENTS

| | | |
|---|---|---|
| JP | 2000-221825 | 8/2000 |
| JP | 2010-008710 | 1/2010 |
| JP | 2013-164438 | 8/2013 |
| JP | 2014-056148 | 3/2014 |
| JP | 2017-151286 | 8/2017 |
| JP | 2018-045083 | 3/2018 |

* cited by examiner

*Primary Examiner* — Thomas S Giampaolo, II
(74) *Attorney, Agent, or Firm* — Harness, Dickey & Pierce, P.L.C.

(57) ABSTRACT

A fixing device includes a heater including a first sealing portion and a second sealing portion disposed at a first lateral end and a second lateral end of a tube in a longitudinal direction of a fixing rotator, respectively. The first sealing portion includes a first inboard end distanced from a first lateral end of a heat generating portion with a first distance in the longitudinal direction of the fixing rotator. The second sealing portion includes a second inboard end distanced from a second lateral end of the heat generating portion with a second distance in the longitudinal direction of the fixing rotator. The second distance is smaller than the first distance. A driving force transmitter transmits a driving force to the fixing rotator or an opposed rotator and is disposed in a first lateral end side of the fixing device where the first sealing portion is disposed.

15 Claims, 6 Drawing Sheets

FIXING DEVICE AND IMAGE FORMING APPARATUS

CROSS-REFERENCE TO RELATED APPLICATION

This patent application is based on and claims priority pursuant to 35 U.S.C. § 119(a) to Japanese Patent Application No. 2019-216861, filed on Nov. 29, 2019, in the Japan Patent Office, the entire disclosure of which is hereby incorporated by reference herein.

BACKGROUND

Technical Field

Exemplary aspects of the present disclosure relate to a fixing device and an image forming apparatus, and more particularly, to a fixing device and an image forming apparatus incorporating the fixing device.

Discussion of the Background Art

Related-art image forming apparatuses, such as copiers, facsimile machines, printers, and multifunction peripherals (MFP) having two or more of copying, printing, scanning, facsimile, plotter, and other functions, typically form an image on a recording medium according to image data by electrophotography.

Such image forming apparatuses include a fixing device including a roller and a belt disposed opposite each other to form a fixing nip therebetween. As a recording medium (e.g., a sheet) bearing an unfixed image is conveyed through the fixing nip, the roller and the belt fix the unfixed image on the recording medium under heat.

SUMMARY

This specification describes below an improved fixing device. In one embodiment, the fixing device includes a fixing rotator, an opposed rotator that contacts the fixing rotator to form a nip between the fixing rotator and the opposed rotator, and a heater that heats the fixing rotator. The heater includes a tube and a heat generating portion disposed inside the tube. A first sealing portion is disposed at a first lateral end of the tube in a longitudinal direction of the fixing rotator and includes a first inboard end distanced from a first lateral end of the heat generating portion with a first distance in the longitudinal direction of the fixing rotator. A second sealing portion is disposed at a second lateral end of the tube in the longitudinal direction of the fixing rotator and includes a second inboard end distanced from a second lateral end of the heat generating portion with a second distance in the longitudinal direction of the fixing rotator. The second distance is smaller than the first distance. A driving force transmitter transmits a driving force to one of the fixing rotator and the opposed rotator and is disposed in a first lateral end side of the fixing device, that is defined by a center of the fixing rotator in the longitudinal direction of the fixing rotator. The first sealing portion is disposed in the first lateral end side of the fixing device.

This specification further describes an improved image forming apparatus. In one embodiment, the image forming apparatus includes an image forming device that forms an image on a recording medium and a fixing device that fixes the image on the recording medium and includes the heater described above.

BRIEF DESCRIPTION OF THE DRAWINGS

A more complete appreciation of the embodiments and many of the attendant advantages and features thereof can be readily obtained and understood from the following detailed description with reference to the accompanying drawings, wherein.

Figure 1:
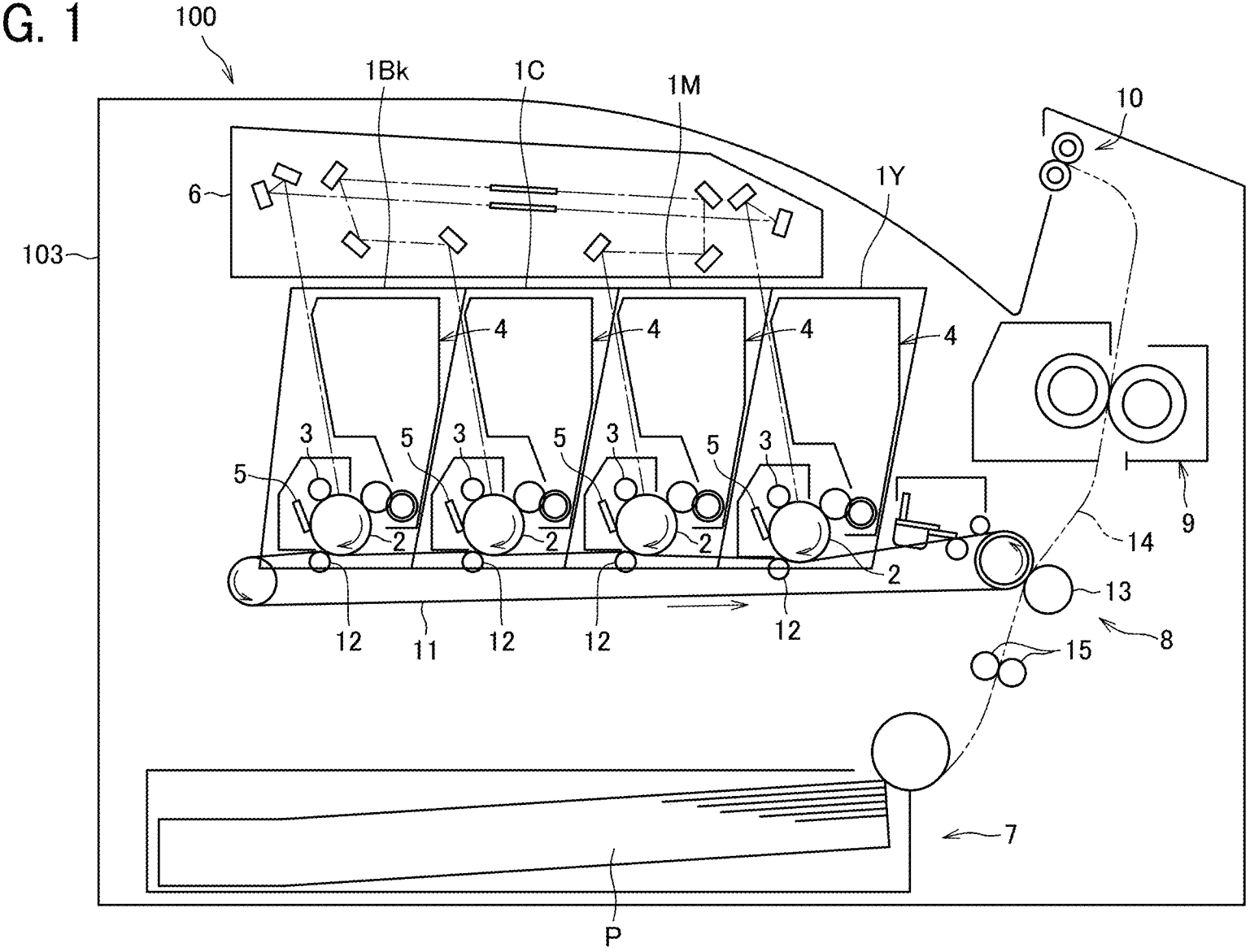
FIG. 1 is a schematic cross-sectional view of an image forming apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted. Also, identical or similar reference numerals designate identical or similar components throughout the several views.

DETAILED DESCRIPTION

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

As used herein, the singular forms "a", "an", and "the" are intended to include the plural forms as well, unless the context clearly indicates otherwise.

Referring to the attached drawings, the following describes embodiments of the present disclosure. In the drawings for explaining the embodiments of the present disclosure, identical reference numerals are assigned to elements such as members and parts that have an identical function or an identical shape as long as differentiation is possible and a description of those elements is omitted once the description is provided.

FIG. 1 is a schematic cross-sectional view of an image forming apparatus 100 according to an embodiment of the present disclosure.

As illustrated in FIG. 1, the image forming apparatus 100 includes four image forming units 1Y, 1M, 1C, and 1Bk serving as image forming devices, respectively. The image forming units 1M, 1C, and 1Bk are removably installed in an apparatus body 103 of the image forming apparatus 100. The image forming units 1Y, 1M, 1C, and 1Bk have a similar construction except that the image forming units 1Y, 1M, 1C, and 1Bk contain developers in different colors, that is, yellow, magenta, cyan, and black, respectively, which correspond to color separation components for a color image. For example, each of the image forming units 1Y, 1M, 1C, and 1Bk includes a photoconductor 2, a charger 3, a developing device 4, and a cleaner 5. The photoconductor 2 is drum-shaped and serves as an image bearer. The charger 3 charges a surface of the photoconductor 2. The developing device 4 supplies toner as a developer to the surface of the photoconductor 2 to form a toner image. The cleaner 5 cleans the surface of the photoconductor 2.

The image forming apparatus 100 further includes an exposure device 6, a sheet feeding device 7, a transfer device 8, a fixing device 9, and a sheet ejection device 10. The exposure device 6 exposes the surface of each of the photoconductors 2 and forms an electrostatic latent image thereon. The sheet feeding device 7 supplies a sheet P serving as a recording medium to the transfer device 8. The transfer device 8 transfers the toner image formed on each of the photoconductors 2 onto the sheet P. The fixing device 9 fixes the toner image transferred onto the sheet P thereon. The sheet ejection device 10 ejects the sheet P onto an outside of the image forming apparatus 100.

The transfer device 8 includes an intermediate transfer belt 11, four primary transfer rollers 12, and a secondary transfer roller 13. The intermediate transfer belt 11 is an endless belt serving as an intermediate transferor stretched taut across a plurality of rollers. The four primary transfer rollers 12 serve as primary transferors that transfer yellow, magenta, cyan, and black toner images formed on the photoconductors 2 onto the intermediate transfer belt 11, respectively, thus forming a full color toner image on the intermediate transfer belt 11. The secondary transfer roller 13 serves as a secondary transferor that transfers the full color toner image formed on the intermediate transfer belt 11 onto the sheet P. The plurality of primary transfer rollers 12 is pressed against the photoconductors 2, respectively, via the intermediate transfer belt 11. Thus, the intermediate transfer belt 11 contacts each of the photoconductors 2, forming a primary transfer nip therebetween. On the other hand, the secondary transfer roller 13 is pressed against one of the rollers across which the intermediate transfer belt 11 is stretched taut via the intermediate transfer belt 11. Thus, a secondary transfer nip is formed between the secondary transfer roller 13 and the intermediate transfer belt 11.

The image forming apparatus 100 accommodates a sheet conveyance path 14 through which the sheet P fed from the sheet feeding device 7 is conveyed. A timing roller pair 15 is disposed in the sheet conveyance path 14 at a position between the sheet feeding device 7 and the secondary transfer nip defined by the secondary transfer roller 13.

Referring to FIG. 1, a description is provided of printing processes performed by the image forming apparatus 100 having the construction described above.

When the image forming apparatus 100 receives an instruction to start printing, a driver drives and rotates the photoconductor 2 clockwise in FIG. 1 in each of the image forming units 1N, 1M, 1C, and 1Bk. The charger 3 charges the surface of the photoconductor 2 uniformly at a high electric potential. Subsequently, the exposure device 6 exposes the surface of each of the photoconductors 2 based on image data created by an original scanner that reads an image on an original or print data instructed by a terminal, thus decreasing the electric potential of an exposed portion on the photoconductor 2 and forming an electrostatic latent image on the photoconductor 2. The developing device 4 supplies toner to the electrostatic latent image formed on the photoconductor 2, forming a toner image thereon.

When the toner images formed on the photoconductors 2 reach the primary transfer nips defined by the primary transfer rollers 12 in accordance with rotation of the photoconductors 2, the toner images formed on the photoconductors 2 are transferred onto the intermediate transfer belt 11 driven and rotated counterclockwise in FIG. 1 successively such that the toner images are superimposed on the intermediate transfer belt 11, forming a full color toner image thereon. Thereafter, the full color toner image formed on the intermediate transfer belt 11 is conveyed to the secondary transfer nip defined by the secondary transfer roller 13 in accordance with rotation of the intermediate transfer belt 11 and is transferred onto a sheet P conveyed to the secondary transfer nip. The sheet P is supplied from the sheet feeding device 7. The timing roller pair 15 temporarily halts the sheet P supplied from the sheet feeding device 7. Thereafter, the timing roller pair 15 conveys the sheet P to the secondary transfer nip at a time when the full color toner image formed on the intermediate transfer belt 11 reaches the secondary transfer nip. Accordingly, the full color toner image is transferred onto and borne on the sheet P. After the toner image is transferred onto the intermediate transfer belt 11, the cleaner 5 removes residual toner remained on the photoconductor 2 therefrom.

The sheet P transferred with the full color toner image is conveyed to the fixing device 9 that fixes the full color toner image on the sheet P. Thereafter, the sheet ejection device 10 ejects the sheet P onto the outside of the image forming apparatus 100, thus finishing a series of printing processes.

A description is provided of a construction of the fixing device 9.

Figure 2:
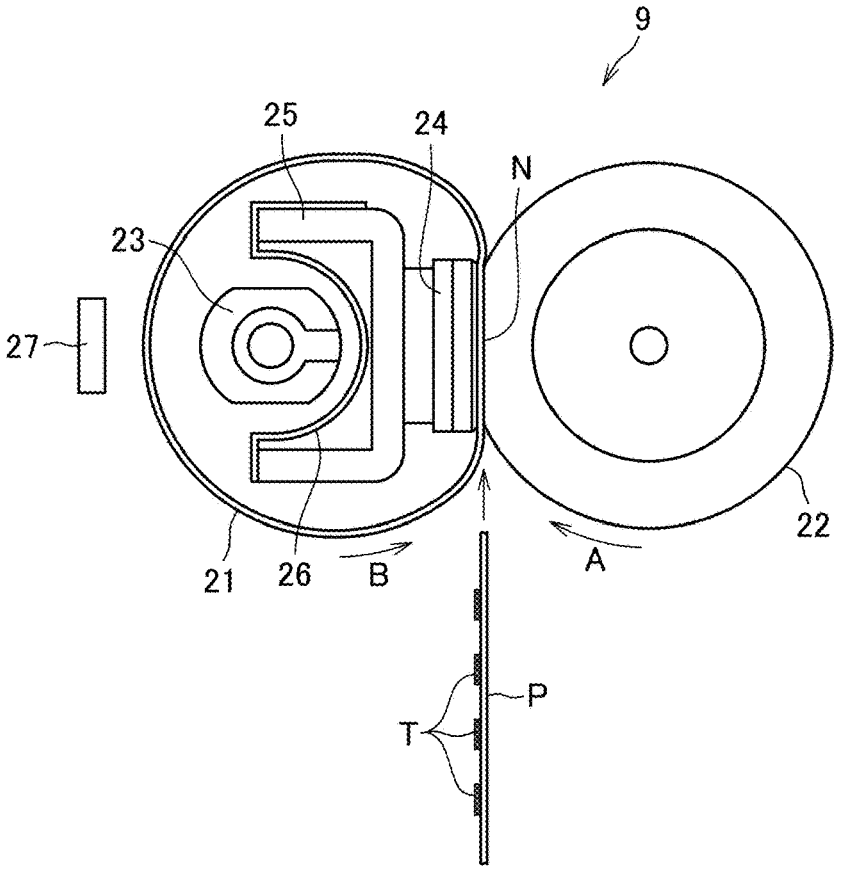
FIG. 2 is a schematic cross-sectional view of a fixing device incorporated in the image forming apparatus depicted in FIG. 1.

As illustrated in FIG. 2, the fixing device 9 includes a fixing belt 21, a pressure roller 22, a halogen heater 23, a nip former 24, a stay 25, a reflector 26, and temperature sensors 27.

A description is provided of a construction of the fixing belt 21.

The fixing belt 21 serves as a fixing rotator or a fixing member that fixes an unfixed toner image T on a sheet P. The fixing belt 21 is disposed opposite an unfixed toner image bearing side of the sheet P, that bears the unfixed toner image T. According to this embodiment, the fixing belt 21 is an endless belt or film that includes a base layer and a release layer. The base layer serves as an inner circumferential surface layer of the fixing belt 21 and is made of metal such as nickel and SUS stainless steel or resin such as polyimide. The release layer serves as an outer circumferential surface layer of the fixing belt 21 and is made of tetrafluoroethylene-perfluoroalkylvinylether copolymer (PFA), polytetrafluoroethylene (PTFE), or the like. Optionally, an elastic layer made of rubber such as silicone rubber, silicone rubber foam, and fluororubber may be interposed between the base layer and the release layer. If the elastic layer has a thickness of about 100 μm, when the fixing belt 21 presses against the sheet P to fix the unfixed toner image T (e.g., unfixed toner) on the sheet P, the elastic layer elastically deforms and absorbs slight surface asperities of the fixing belt 21, preventing uneven gloss of the toner image T on the sheet P.

According to this embodiment, in order to decrease the thermal capacity of the fixing belt 21, a belt that is thin and has a decreased diameter is employed as the fixing belt 21. For example, the base layer of the fixing belt 21 has a thickness in a range of from 20 μm to 50 μm. The release layer of the fixing belt 21 has a thickness in a range of from 10 μm to 50 μm. The fixing belt 21 has a total thickness of 1 mm or smaller. If the fixing belt 21 has the elastic layer, the elastic layer preferably has a thickness in a range of from 100 μm to 300 μm. In order to decrease the thermal capacity of the fixing belt 21 further, the fixing belt 21 has a total thickness of 0.2 mm or smaller preferably and 0.16 mm or smaller more preferably. According to this embodiment, the fixing belt 21 has a diameter in a range of from 20 mm to 40 mm. The fixing belt 21 preferably has a diameter of 30 mm or smaller.

A description is provided of a construction of the pressure roller 22.

The pressure roller 22 serves as an opposed rotator or an opposed member that is disposed opposite an outer circumferential surface of the fixing belt 21. The pressure roller 22 also serves as a pressure rotator or a pressure member that presses against the outer circumferential surface of the fixing belt 21. The pressure roller 22 presses against the fixing belt 21 to form a fixing nip N therebetween. According to this embodiment, the pressure roller 22 includes a cored bar, an elastic layer, and a release layer. The elastic layer is disposed on a surface of the cored bar and is made of silicone rubber foam, fluororubber, or the like. The release layer is disposed on a surface of the elastic layer and is made of PFA, PTFE, or the like. The pressure roller 22 may be a solid roller or a hollow roller. If the pressure roller 22 is a hollow roller, a heater such as a halogen heater may be disposed inside the pressure roller 22. The elastic layer of the pressure roller 22 may be made of solid rubber. Alternatively, if no heater is disposed inside the pressure roller 22, the elastic layer is preferably made of sponge rubber to improve thermal insulation of the pressure roller 22, Accordingly, the elastic layer prevents the pressure roller 22 from drawing heat from the fixing belt 21 easily, improving efficiency in heating the fixing belt 21.

A driver disposed inside the apparatus body 103 of the image forming apparatus 100 depicted in FIG. 1 drives and rotates the pressure roller 22 in a rotation direction A depicted in FIG. 2. As the pressure roller 22 rotates in the rotation direction A, the pressure roller 22 drives and rotates the fixing belt 21 in a rotation direction B in accordance with rotation of the pressure roller 22. As the sheet P bearing the unfixed toner image T enters the fixing nip N formed between the fixing belt 21 and the pressure roller 22, the fixing belt 21 and the pressure roller 22, that rotate, convey the sheet P through the fixing nip N. The fixing belt 21 and the pressure roller 22 apply heat and pressure to the sheet P, fixing the unfixed toner image 1 on the sheet P.

A description is provided of a configuration of the halogen heater 23.

The halogen heater 23 serves as a heater that heats the fixing belt 21. The halogen heater 23 is disposed inside a loop formed by the fixing belt 21. The halogen heater 23 emits infrared light that irradiates an inner circumferential surface of the fixing belt 21 directly, thus heating the fixing belt 21. Alternatively, as an infrared heater that heats the fixing belt 21, a carbon heater, a sheath heater, or the like may be employed instead of a halogen heater. The number of heaters that heat the fixing belt 21 is not limited to one and may be two or more.

A description is provided of a configuration of the nip former 24.

The nip former 24 and the pressure roller 22 sandwich the fixing belt 21 and define the fixing nip N. The nip former 24 (e.g., a nip formation pad) is disposed inside the loop formed by the fixing belt 21 and extends continuously throughout an entire length of the fixing belt 21 in a longitudinal direction, that is, an axial direction, of the fixing belt 21. As pressers such as springs press the pressure roller 22 against the nip former 24 via the fixing belt 21, the pressure roller 22 comes into contact with the fixing belt 21, forming the fixing nip N therebetween. The nip former 24 is preferably made of heat resistant resin to prevent thermal deformation and form the fixing nip N stably.

In order to facilitate sliding of the fixing belt 21 over the nip former 24, a sheet type slide aid (e.g., a slide sheet) made of a low friction material such as PTFE may be interposed between the nip former 24 and the fixing belt 21. Alternatively, the nip former 24 may contact the fixing belt 21 directly without the slide aid interposed therebetween.

A description is provided of a configuration of the stay 25.

The stay 25 serves as a support that supports the nip former 24 against pressure from the pressure roller 22. The stay 25 supporting the nip former 24 contacts a stay side face of the nip former 24, that is opposite a pressure roller side face of the nip former 24, that is disposed opposite the pressure roller 22. The stay 25 suppresses bending of the nip former 24 by pressure from the pressure roller 22. For example, the stay 25 suppresses bending of the nip former 24 in a pressurization direction of the pressure roller 22 throughout an entire length of the nip former 24 in a longitudinal direction thereof. Like the nip former 24, the stay 25 extends continuously throughout the entire length of the fixing belt 21 in the longitudinal direction thereof. The stay 25 supports the nip former 24 throughout the entire length of the fixing belt 21 in the longitudinal direction thereof, suppressing bending of the nip former 24 and attaining the fixing nip N having an even length in a sheet conveyance direction of the sheet P throughout the entire length of the fixing belt 21 in the longitudinal direction thereof. The stay 25 is preferably made of ferrous metal such as SUS stainless steel and steel electrolytic cold commercial (SECC) to achieve rigidity.

A description is provided of a configuration of the reflector 26.

The reflector 26 reflects infrared light or heat radiated from the halogen heater 23. The reflector 26 is interposed between the halogen heater 23 and the stay 25. The reflector 26 reflects infrared light or heat radiated from the halogen heater 23 to the fixing belt 21, heating the fixing belt 21 effectively. The reflector 26 also suppresses redundant conduction of heat to the stay 25 and the like, saving energy. The reflector 26 is made of aluminum, stainless steel, or the like.

A description is provided of a configuration of the temperature sensors 27.

Each of the temperature sensors 27 serves as a temperature detector that detects the temperature of the fixing belt 21. According to this embodiment, two temperature sensors 27 are disposed opposite the outer circumferential surface of the fixing belt 21 at two positions, respectively, that is, a center and a lateral end of the fixing belt 21 in the longitudinal direction thereof. When the temperature sensors 27 detect the temperature of the outer circumferential surface of the fixing belt 21, a controller controls output to the halogen heater 23 based on the temperature of the fixing belt 21, that is detected by the temperature sensors 27, thus retaining a desired temperature (e.g., a fixing temperature) of the fixing belt 21. General temperature sensors such as a thermopile, a thermostat, a thermistor, and a normally closed (NC) sensor are used as the temperature sensors 27. Each of the temperature sensors 27 may be a non-contact type sensor that does not contact the fixing belt 21 or a contact type sensor that contacts the fixing belt 21.

Figure 3:
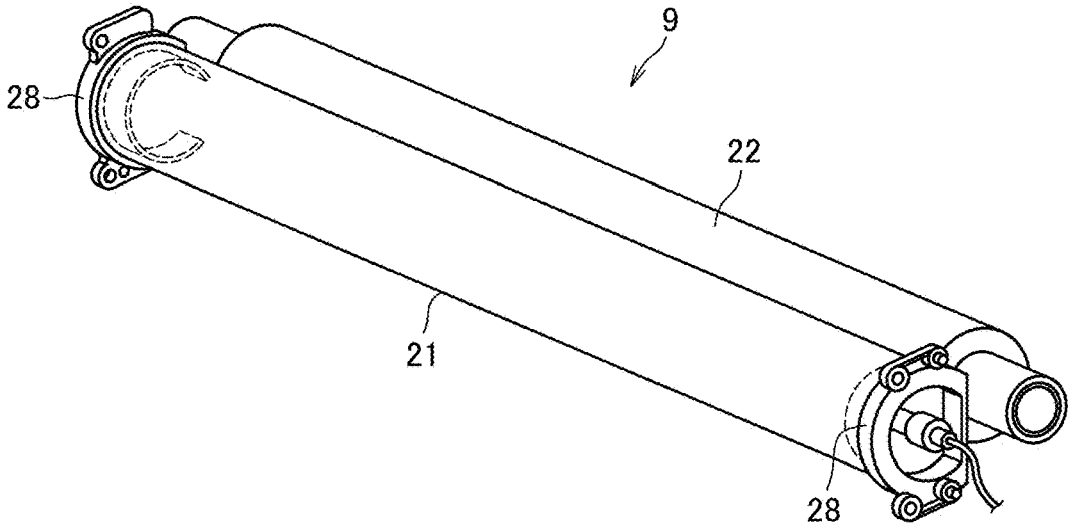
FIG. 3 is a perspective view of the fixing device depicted in FIG. 2.

As illustrated in FIG. 3, the fixing device 9 further includes a pair of belt holders 28 serving as a pair of holders that holds or supports the fixing belt 21 at both lateral ends of the fixing belt 21 in the longitudinal direction thereof, respectively.

Figure 4:
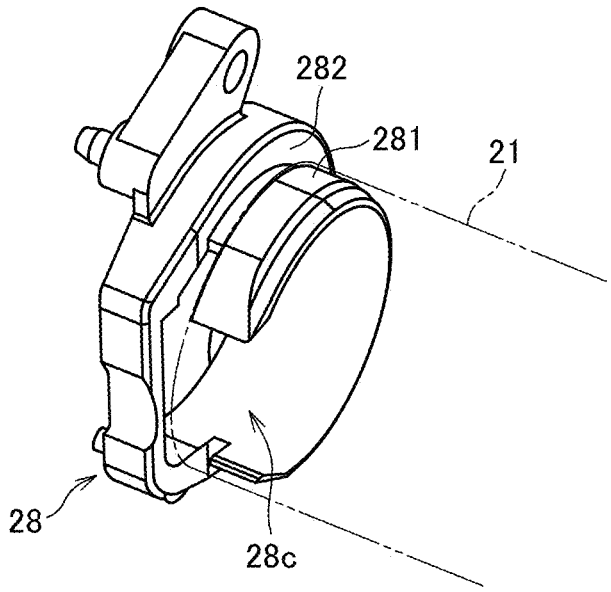
FIG. 4 is a perspective view of a belt holder incorporated in the fixing device depicted in FIG. 3.

As illustrated in FIG. 4, the belt holder 28 includes a holding portion 281 and a restricting portion 282. The holding portion 281 is C-shaped or tubular and inserted into the loop formed by the fixing belt 21, thus contacting the inner circumferential surface of the fixing belt 21 to hold or support the fixing belt 21. The restricting portion 282 is a flange that contacts an edge face of the fixing belt 21 to restrict motion (e.g., skew) of the fixing belt 21 in the longitudinal direction thereof, thus restricting the position of the fixing belt 21. As the pair of holding portions 281 is inserted into both lateral ends of the fixing belt 21 in the longitudinal direction thereof, the holding portions 281 rotatably hold the fixing belt 21. In a stationary state in which the fixing belt 21 does not rotate, the belt holders 28 support the fixing belt 21 in a state in which the fixing belt 21 is not basically applied with tension in a circumferential direction thereof, that is, by a free belt system.

Figure 5:
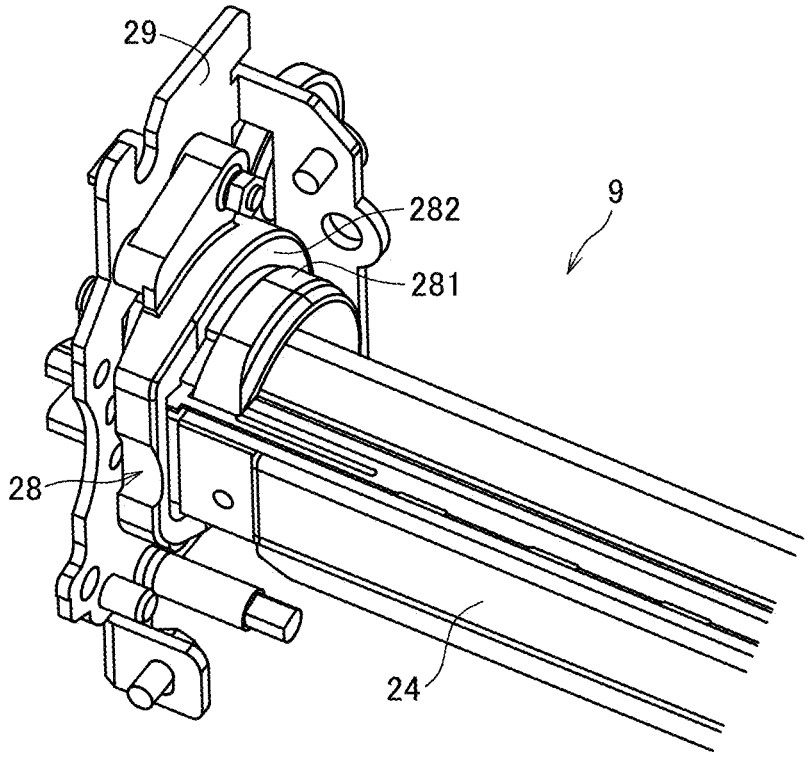
FIG. 5 is a perspective view of the fixing device depicted in FIG. 3, illustrating one lateral end of the fixing device in a longitudinal direction thereof.

As illustrated in FIG. 5, the belt holder 28 is secured to a side plate 29 serving as a side wall of the fixing device 9. As illustrated in FIG. 4, an aperture 28*c* is disposed inside the belt holder 28 on an inner periphery of the belt holder 28. The aperture 28*c* penetrates through the holding portion 281 and the restricting portion 282 in the longitudinal direction of the fixing belt 21. A lateral end of each of the halogen heater 23 and the stay 25 is secured to the side plate 29 through the aperture 28*c*. The side plates 29 are disposed at both lateral ends of the fixing device 9 in the longitudinal direction of the fixing belt 21, respectively. Although FIG. 5 illustrates the belt holder 28 secured to the side plate 29 disposed at one lateral end of the fixing device 9 in the longitudinal direction of the fixing belt 21, the belt holder 28 and another lateral end of each of the halogen heater 23 and the stay 25 are also secured to the side plate 29 disposed at another lateral end of the fixing device 9 in the longitudinal direction of the fixing belt 21 similarly.

Figure 6:
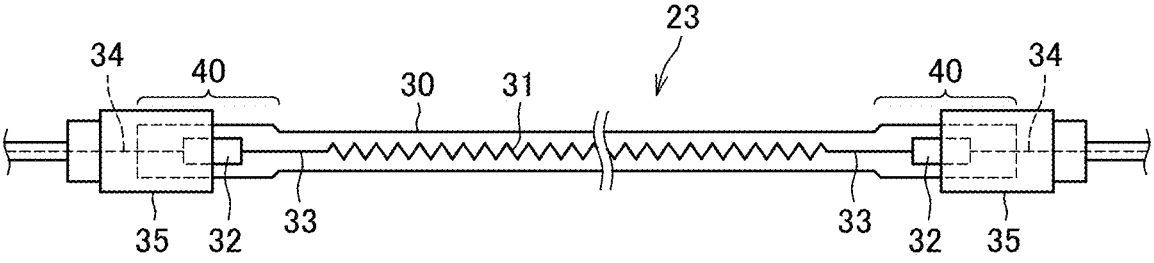
FIG. 6 is a schematic cross-sectional view of a halogen heater incorporated in the fixing device depicted in FIG. 2.

FIG. 6 is a schematic diagram of the halogen heater 23.

As illustrated in FIG. 6, the halogen heater 23 includes a bulb 30, a filament 31, metal foil 32 internal lead wires 33, external lead wires 34, and insulators 35. The bulb 30 is tubular and serves as a tube made of fused quartz or the like. The filament 31 serves as a heat generator accommodated in the bulb 30. The metal foil 32 is thin and made of molybdenum or the like.

The filament 31 is produced by metal wire that is coiled and made of tungsten or the like. The filament 31 is disposed inside the bulb 30 and extended in a longitudinal direction of the bulb 30. The bulb 30 is filled with a halogen substance and inert gas. Sealing portions 40 are disposed at both lateral ends of the bulb 30 in the longitudinal direction thereof, respectively. The sealing portions 40 are flattened to prevent the inert gas from leaking from an interior of the bulb 30. Each of the insulators 35 covers at least a part of the sealing portion 40. The metal foil 32 is disposed inside each of the sealing portions 40. The metal foil 32 is connected to both lateral ends of the filament 31 in the longitudinal direction of the bulb 30 through the internal lead wires 33, respectively. Each of the external lead wires 34 is connected to an outboard end of the metal foil 32, that is opposite an inboard end of the metal foil 32, that is coupled to the internal lead wire 33. A part of each of the external lead wires 34 is exposed from the sealing portion 40 and connected to a power supply through a terminal such as a harness and a connector.

In a state in which the halogen heater 23 is connected to the power supply, when the power supply supplies power to the halogen heater 23, the filament 31 is energized and generates heat. Conversely, when the metal foil 32, the internal lead wires 33, and the external lead wires 34 are energized, the metal foil 32, the internal lead wires 33, and the external lead wires 34 barely generate heat. Thus, in the halogen heater 23, the filament 31, that is, the coiled metal wire, generates heat mainly. Hereinafter, the filament 31 that generates heat mainly (e.g., a main heat generating portion) serves as a heat generating portion of the halogen heater 23.

Figure 7:
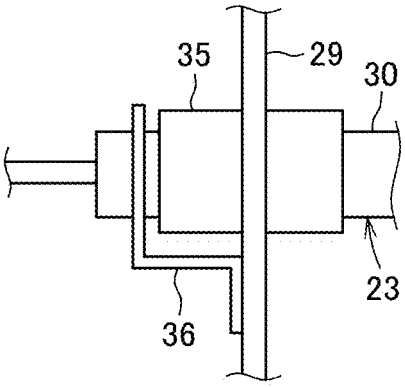
FIG. 7 is a diagram of the halogen heater depicted in FIG. 6, illustrating one lateral end of the halogen heater in a longitudinal direction thereof.

As illustrated in FIG. 7, the fixing device 9 further includes a position restrictor 36 mounted on the lateral end of the halogen heater 23 in the longitudinal direction of the fixing belt 21. The position restrictor 36 restricts motion of the halogen heater 23 horizontally in FIG. 7 in the longitudinal direction of the fixing belt 21, thus restricting the position of the halogen heater 23. According to this embodiment, the position restrictor 36 is secured to an outer circumferential surface of the insulator 35 and the side plate 29. Thus, the position restrictor 36 and the side plate 29 hold the halogen heater 23 such that the halogen heater 23 does not move in the longitudinal direction of the fixing belt 21.

Figure 8:
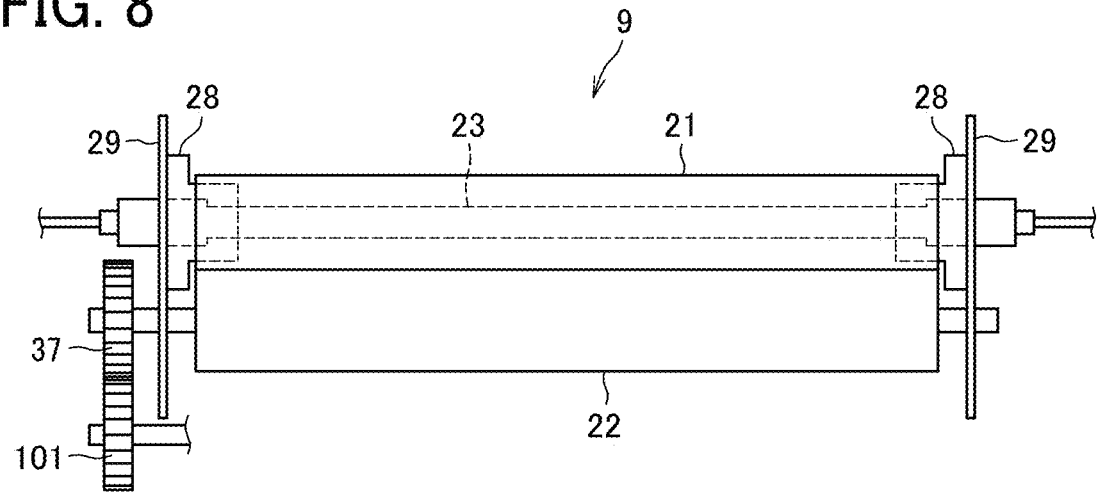
FIG. 8 is a front view of the fixing device depicted in FIG. 3.

FIG. 8 is a front view of the fixing device 9.

As illustrated in FIG. 8, the fixing device 9 according to this embodiment includes a driving force transmitting gear 37. The driving force transmitting gear 37 is disposed at one lateral end of the pressure roller 22 in an axial direction, that is, a longitudinal direction, of the pressure roller 22. The driving force transmitting gear 37 serves as a driving force transmitter that transmits a driving force generated by the driver to the pressure roller 22. Accordingly, when the fixing device 9 is installed in the apparatus body 103 of the image forming apparatus 100, the driving force transmitting gear 37 meshes and couples with a gear 101 disposed inside the apparatus body 103 of the image forming apparatus 100 so that the driving force transmitting gear 37 transmits the driving force generated by the driver to the pressure roller 22.

In the fixing device 9 according to this embodiment, the driving force transmitting gear 37 is disposed at one lateral end of the pressure roller 22 in the axial direction thereof. Friction between the driving force transmitting gear 37 and the gear 101 disposed inside the apparatus body 103 generates heat that increases the temperature of one lateral end of the fixing belt 21 in the axial direction thereof that is disposed in proximity to the driving force transmitting gear 37. Accordingly, when the halogen heater 23 generates heat and the temperature of an interior inside the loop formed by the fixing belt 21 increases, a temperature of one lateral end of the halogen heater 23 in a longitudinal direction thereof, that is disposed in proximity to the driving force transmitting gear 37, is higher than a temperature of another lateral end of the halogen heater 23 in the longitudinal direction thereof. For example, if the image forming apparatus 100 has an improved productivity (e.g., if the image forming apparatus 100 performs an increased number of prints per unit time), the halogen heater 23 generates an increased amount of heat. Accordingly, the temperature of one lateral end of the halogen heater 23 in the longitudinal direction thereof, that is disposed in proximity to the driving force transmitting gear 37, may exceed a heat resistant temperature of the halogen heater 23.

Additionally, the sealing portions 40 of the halogen heater 23 may suffer from a crack (e.g., a microcrack) at a high temperature as a structural defect. For example, since the metal foil 32 is disposed inside the sealing portion 40, when the sealing portion 40 has an increased temperature, the metal foil 32 is oxidized and suffers from volume expansion. Volume expansion of the metal foil 32 generates a force that presses and stretches an interior of the sealing portion 40. When the sealing portion 40 does not endure the force, the sealing portion 40 generates a crack.

A description is provided of a construction of a comparative fixing device.

The comparative fixing device includes a heating roller, a pressure roller that presses against the heating roller to form a nip therebetween, and a halogen heater that heats the heating roller. A driving gear is disposed at one lateral end of the heating roller in an axial direction thereof. A driving force generated by a driver is input to the heating roller through the driving gear.

In the comparative fixing device, a driving force transmitter such as the driving gear disposed at one lateral end of the heating roller in the axial direction thereof. The driving gear meshes with a gear frictionally, generating heat and the like that increase the temperature of one lateral end of the heating roller in the axial direction thereof. As a heater installed in the comparative fixing device, a heater, such as a halogen heater, that includes sealing portions, may be employed. The sealing portions are disposed at both lateral ends of a glass tube in a longitudinal direction thereof, respectively. In this case, the sealing portion disposed in proximity to the driving force transmitter may suffer from overheating.

To address those circumstances, the fixing device 9 according to this embodiment has a construction described below to suppress overheating of the sealing portion 40 disposed in proximity to the driving force transmitting gear 37.

A description is provided of an advantageous construction of the fixing device 9 in comparison with a construction of a comparative example.

Figure 9:
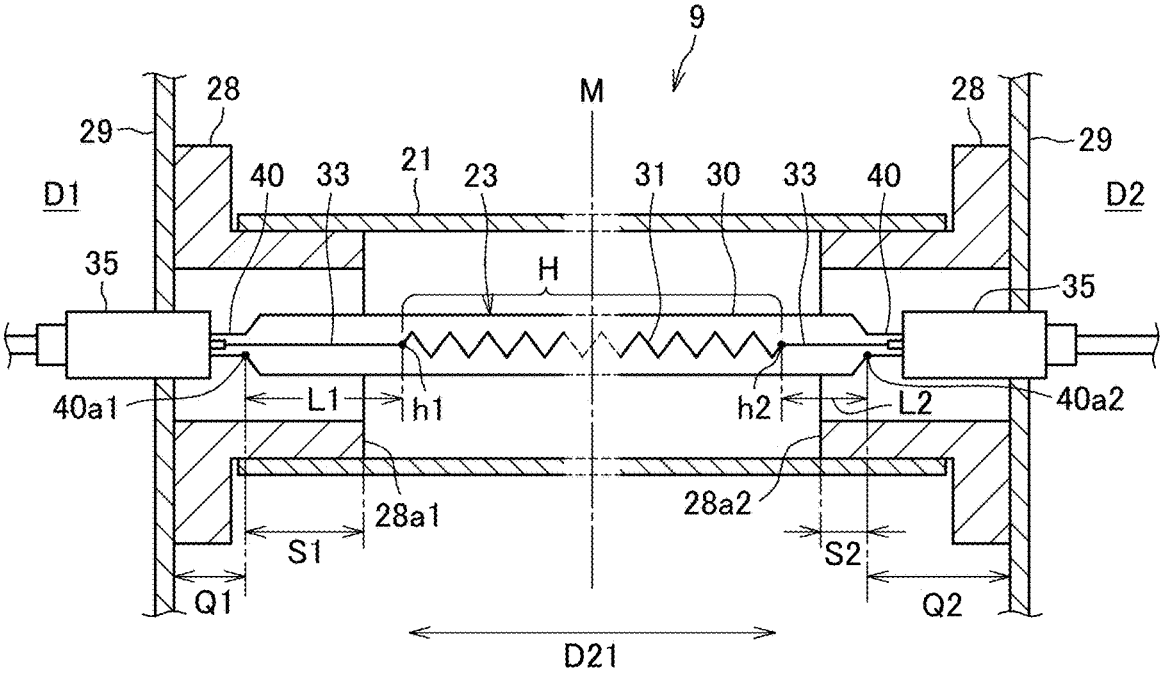
FIG. 9 is a schematic cross-sectional view of the fixing device depicted in FIG. 3.
Figure 10:
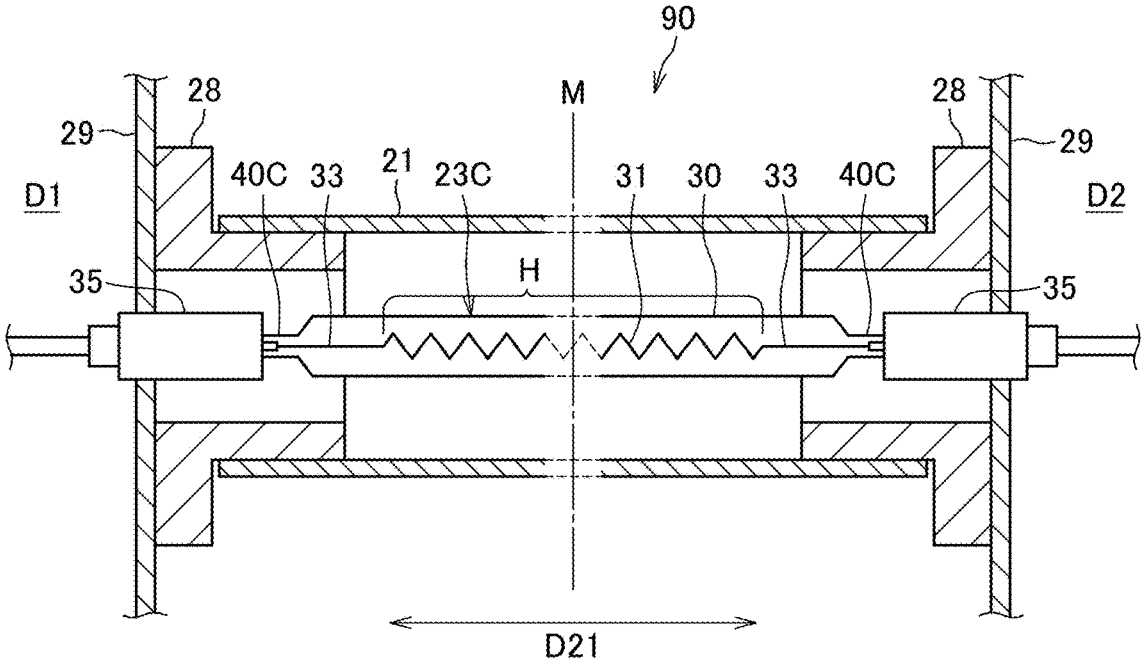
FIG. 10 is a schematic cross-sectional view of a fixing device according to a comparative example.

FIG. 9 is a schematic diagram of the fixing device 9 according to an embodiment of the present disclosure, illustrating the advantageous construction. FIG. 10 is a schematic diagram of a fixing device 90 according to the comparative example. In FIGS. 9 and 10, a left side defines a driving side D1 where the driving force transmitting gear 37 depicted in FIG. 8 that transmits the driving force generated by the driver to the pressure roller 22 is disposed. A right side defines a non-driving side D2 where the driving force transmitting gear 37 is not disposed. The driving side D1 is disposed in one lateral end side of the fixing device 9 and the non-driving side D2 is disposed in another lateral end side of the fixing device 9 in a longitudinal direction D21 of the fixing belt 21.

As illustrated in FIG. 10 illustrating the fixing device 90 according to the comparative example, the fixing device 90 includes a halogen heater 23C that includes a heat generating portion H (e.g., the filament 31 that generates heat mainly). The heat generating portion H, the pair of belt holders 28, and the pair of side plates 29 are generally symmetric with respect to a center M of the fixing belt 21 in the longitudinal direction D21 thereof or a center of the sheet P in a width direction thereof, that is conveyed over the fixing belt 21. The halogen heater 23C is generally symmetric in a longitudinal direction thereof structurally. Hence, sealing portions 40C of the halogen heater 23C are also generally disposed symmetrically with respect to the center M of the fixing belt 21 in the longitudinal direction D21 thereof. A definition that the halogen heater 23C is symmetric in the longitudinal direction thereof also connotes a case in which a center position of the heat generating portion H, a center position between the pair of belt holders 28, a center position between the pair of side plates 29, and a center position between the pair of sealing portions 40C in the longitudinal direction D21 of the fixing belt 21 overlap the center M of the fixing belt 21 in the longitudinal direction D21 thereof with no error or with an error (e.g., a shift) within 2 mm.

Conversely, in the fixing device 9 according to the embodiment of the present disclosure depicted in FIG. 9, like in the fixing device 90 according to the comparative example depicted in FIG. 10, the heat generating portion H (e.g., the filament 31) of the halogen heater 23, the pair of belt holders 28, and the pair of side plates 29 are disposed symmetrically with respect to the center M of the fixing belt 21 in the longitudinal direction D21 thereof or the center of the sheet P in the width direction thereof, that is conveyed over the fixing belt 21. Conversely, arrangement of the pair of sealing portions 40 of the fixing device 9 according to the embodiment of the present disclosure is different from arrangement of the pair of sealing portions 40C of the fixing device 90 according to the comparative example. For example, the sealing portions 40 of the fixing device 9 are not disposed symmetrically with respect to the center M of the fixing belt 21 in the longitudinal direction D21 thereof.

According to this embodiment, as illustrated in FIG. 9, the sealing portion 40 disposed in the driving side D1 (e.g., the left side in FIG. 9) is distanced from the center M of the fixing belt 21 in the longitudinal direction D21 thereof farther than the sealing portion 40 disposed in the non-driving side D2 (e.g., the right side in FIG. 9) is. Hence, a distance between the sealing portion 40 disposed in the driving side D1 and each of the heat generating portion H, the belt holder 28, and the side plate 29 disposed in the driving side D1 is different from a distance between the sealing portion 40 disposed in the non-driving side D2 and each of the heat generating portion H, the belt holder 28, and the side plate 29 disposed in the non-driving side D2, that are disposed symmetrically with those disposed in the driving side D1 with respect to the center M of the fixing belt 21 in the longitudinal direction D21 thereof. The distance described below denotes a distance in the longitudinal direction D21 of the fixing belt 21.

For example, as illustrated in FIG. 9, a distance L1 defines a distance from a lateral end h1 of the heat generating portion H in the driving side D1 to an inboard end 40*a*1 of the sealing portion 40 in the driving side D1 in the longitudinal direction D21 of the fixing belt 21. A distance L2 defines a distance from a lateral end h2 of the heat generating portion H in the non-driving, side D2 to an inboard end 40*a*2 of the sealing portion 40 in the non-driving side D2 in the longitudinal direction D21 of the fixing belt 21. The distance L1 is greater than the distance L2. Hereinafter, each of the inboard ends 40*a*1 and 40*a*2 of the sealing portion 40 in the longitudinal direction D21 of the fixing belt 21 denotes an inboardmost part of the sealing portion 40 in a case in which a part of the sealing portion 40, that is in proximity to the center M of the fixing belt 21 in the longitudinal direction D21 thereof, defines an inboard part and a part of the sealing portion 40, that is in proximity to the lateral end of the fixing belt 21 in the longitudinal direction D21 thereof, defines an outboard part.

As illustrated in FIG. 9, a distance Q1 defines a distance from the side plate 29 in the driving side D1 to the inboard end 40*a*1 of the sealing portion 40 in the driving side D1 in the longitudinal direction D21 of the fixing belt 21. A distance Q2 defines a distance from the side plate 29 in the non-driving side D2 to the inboard end 40*a*2 of the sealing portion 40 in the non-driving side D2 in the longitudinal direction D21 of the fixing belt 21. The distance Q1 is smaller than the distance Q2.

Further, as illustrated in FIG. 9, a distance S1 defines a distance from an inboard end 28*a*1 of the belt holder 28 in the driving side D1 to the inboard end 40*a*1 of the sealing portion 40 in the driving side D1 in the longitudinal direction D21 of the fixing belt 21. A distance S2 defines a distance from an inboard end 28*a*2 of the belt holder 28 in the non-driving side D2 to the inboard end 40*a*2 of the sealing portion 40 in the non-driving side D2 in the longitudinal direction D21 of the fixing belt 21. The distance S1 is greater than the distance S2. Hereinafter, each of the inboard ends 28*a*1 and 28*a*2 of the belt holder 28 in the longitudinal direction D21 of the fixing belt 21 denotes an inboardmost part of the belt holder 28 in a case in which a part of the belt holder 28, that is in proximity to the center M of the fixing belt 21 in the longitudinal direction D21 thereof, defines an inboard part and a part of the belt holder 28, that is in proximity to the lateral end of the fixing belt 21 in the longitudinal direction D21 thereof, defines an outboard part.

As described above, in the fixing device 9 according to the embodiment of the present disclosure, the sealing portion 40 disposed in the driving side D1 is distanced from the center M of the fixing belt 21 in the longitudinal direction D21 thereof farther than the sealing portion 40 disposed in the non-driving side D2 is. Accordingly, the sealing portion 40 that is disposed in the driving side D1 and therefore is subject to temperature increase has a decreased temperature compared to the sealing portion 40C of the fixing device 90 according to the comparative example.

Figure 11:
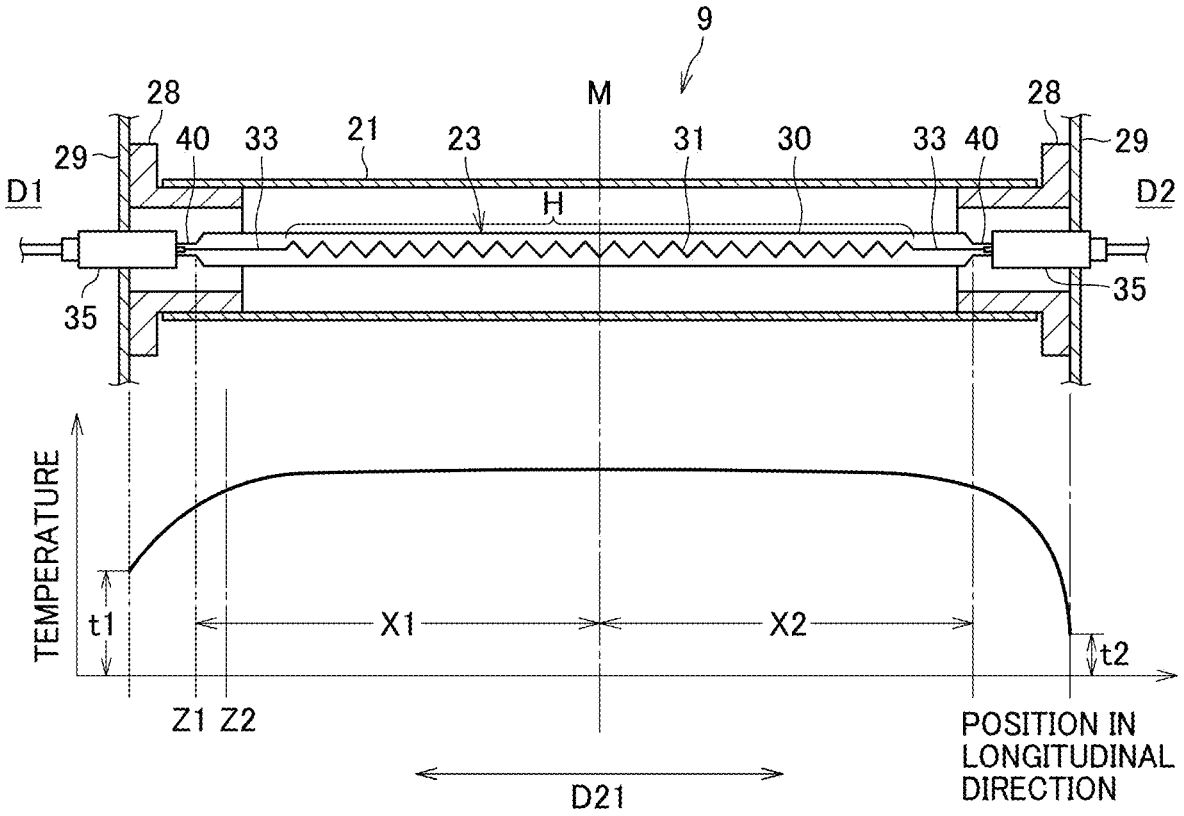
FIG. 11 is a diagram of the fixing device depicted in FIG. 9, illustrating arrangement of a pair of sealing portions and a temperature distribution inside a fixing belt incorporated in the fixing device.

FIG. 11 is a diagram of the fixing device 9 according to the embodiment of the present disclosure, illustrating arrangement of the pair of sealing portions 40 and a temperature distribution inside the fixing belt 21.

As illustrated in FIG. 11, the temperature inside the fixing belt 21 (e.g., the temperature inside the loop formed by the fixing belt 21) increases in a heat generating span in the longitudinal direction D21 of the fixing belt 21, that is disposed opposite the heat generating portion H of the halogen heater 23. The temperature inside the fixing belt 21 decreases gradually toward both lateral ends of the fixing belt 21 in the longitudinal direction D21 thereof. However, due to heat generated by friction between the driving force transmitting gear 37 and the gear 101, a temperature t1 inside the fixing belt 21 at one lateral end of the fixing belt t1 in the longitudinal direction D21 thereof in the driving side D1 is higher than a temperature t2 inside the fixing belt 21 at another lateral end of the fixing belt 21 in the longitudinal direction D21 thereof in the non-driving side D2 (t1>t2). Accordingly, heat inside the fixing belt 21 does not radiate easily at one lateral end of the fixing belt 21 in the longitudinal direction D21 thereof in the driving side D1. Hence, in the comparative fixing device described above and the fixing device 90 according to the comparative example depicted in FIG. 10 in which the pair of sealing portions 40C of the halogen heater 23C are disposed symmetrically with respect to the center M of the fixing belt 21 in the longitudinal direction D21 thereof, the sealing portion 40C disposed in the driving side D1 is subject to temperature increase.

Conversely, in the fixing device 9 according to the embodiment of the present disclosure depicted in FIG. 11, the sealing portion 40 disposed in the driving side D1 is distanced from the center M of the fixing belt 21 in the longitudinal direction D21 thereof farther than the sealing portion 40 disposed in the non-driving side D2 is. For example, a distance X1 from the center M of the fixing belt 21 to the sealing portion 40 in the driving side D1 is greater than a distance X2 from the center M of the fixing belt 21 to the sealing portion 40 in the non-driving side D2 in the longitudinal direction D21 of the fixing belt 21. Accordingly, as illustrated in FIG. 11, the sealing portion 40 disposed in the driving side D1 is situated at a position Z1 different from a position Z2 of the sealing portion 40C disposed in the driving side D1 in the fixing device 90 according to the comparative example or the comparative fixing device. A temperature inside the fixing belt 21 at the position Z1 is lower than a temperature inside the fixing belt 21 at the position Z2. Accordingly, the sealing portion 40 in the driving side D1 barely suffers from temperature increase and radiates heat readily, suppressing overheating.

In order to suppress temperature increase of the sealing portion 40 more effectively, an entirety of the sealing portion 40 is preferably disposed outboard from the side plate 29 in the longitudinal direction D21 of the fixing belt 21. However, in this case, the halogen heater 23 projects beyond the side plate 29 outward for an increased length, upsizing the fixing device 9 disadvantageously. To address this circumstance, in the fixing device 9 according to the embodiment of the present disclosure depicted in FIG. 9, the inboard end 40*a*1 of the sealing portion 40 in the driving side D1 is disposed inboard from the side plate 29 in the driving side D1 in the longitudinal direction D21 of the fixing belt 21, preventing upsizing of the fixing device 9.

As described above, the fixing device 9 according to the embodiment of the present disclosure, while being immune from upsizing, suppresses temperature increase of the sealing portion 40 in the driving side D1, that is subject to overheating. Accordingly, the fixing device 9 prevents the sealing portion 40 from being damaged easily, improving reliability and facilitating downsizing. Further, the fixing device 9 enhances productivity of the image forming apparatus 100.

Additionally, in order to prevent damaging of the sealing portion 40 more precisely, in the fixing device 9 according to the embodiment of the present disclosure, a thermal conductivity of the belt holder 28 may be greater than a thermal conductivity of the fixing belt 21. In this case, the sealing portion 40 radiates heat through the belt holder 28 readily, suppressing temperature increase of the sealing portion 40 more effectively.

The position restrictor 36 depicted in FIG. 7 that restricts the position (e.g., motion) of the halogen heater 23 may be made of metal. Accordingly, the sealing portion 40 radiates heat through the position restrictor 36 readily, suppressing temperature increase of the sealing portion 40 more effectively.

The above describes the construction, the operation, and the advantages of the fixing device 9 according to the embodiments of the present disclosure. However, the technology of the present disclosure is not limited to the embodiments described above and is modified within the scope of the technology of the present disclosure.

Figure 12:
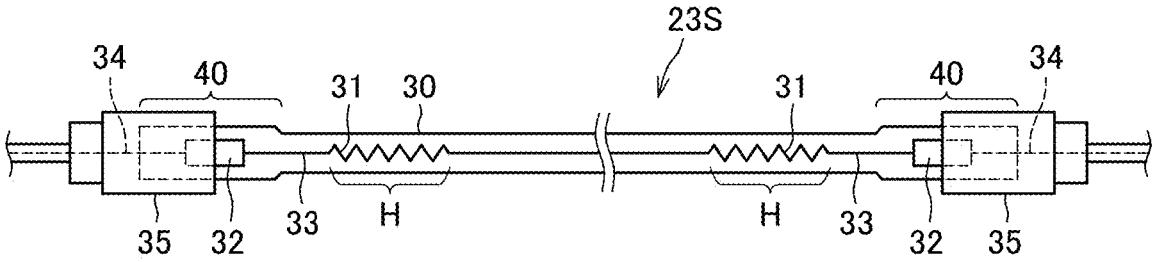
FIG. 12 is a schematic cross-sectional view of a halogen heater incorporating a plurality of heat generating portions, that is installable in the fixing device depicted in FIG. 2.

As illustrated in FIG. 6, the halogen heater 23 according to the embodiments of the present disclosure includes the heat generating portion (e.g., the filament 31) that extends continuously in the longitudinal direction D21 of the fixing belt 21. Alternatively, the halogen heater 23 may include a plurality of heat generating portions that is disposed discontinuously in the longitudinal direction D21 of the fixing belt 21. For example, as illustrated in FIG. 12, a halogen heater 23S includes a plurality of heat generating portions H (e.g., the filaments 31) that is arranged discontinuously in the longitudinal direction D21 of the fixing belt 21. If the heat generating portion is an incandescent lamp, for example, the incandescent lamp includes a light emitting coil produced by densely coiling a filament wire disposed inside a bulb of the incandescent lamp as one example. However, the heat generating portion may have other configurations.

The technology of the present disclosure is applicable to fixing devices other than the fixing device 9 in which the fixing belt 21 and the pressure roller 22 form the fixing nip N. The technology of the present disclosure is also applicable to a fixing device in which a fixing roller (e.g., a heating roller) and a pressure roller form a nip between the fixing roller and the pressure roller. In this case, a driving force transmitter that rotates the fixing roller or the pressure roller may be a driving force transmitting gear disposed at a lateral end of the pressure roller or the fixing roller in an axial direction thereof. The driving force transmitter that transmits a driving force to a fixing rotator (e.g., the fixing roller) or an opposed rotator (e.g., the pressure roller) is not limited to the driving force transmitting gear and may be a rotator (e.g., a pulley) over which a belt is looped.

A description is provided of advantages of a fixing device (e.g., the fixing device 9).

As illustrated in FIGS. 2, 8, 9, and 12, the fixing device includes a fixing rotator (e.g., the fixing belt 21), an opposed rotator (e.g., the pressure roller 22), a heater (e.g., the halogen heaters 23 and 23S), and a driving force transmitter (e.g., the driving force transmitting gear 37).

The opposed rotator contacts the fixing rotator to form a nip (e.g., the fixing nip N) between the fixing rotator and the opposed rotator. The heater heats the fixing rotator. The driving force transmitter transmits a driving force to one of the fixing rotator and the opposed rotator. The heater includes a tube (e.g., the bulb 30) accommodating one heat generating portion or a plurality of heat generating portions (e.g., the heat generating portions H) and a pair of sealing portions (e.g., the sealing portions 40) disposed at both lateral ends of the tube, respectively, in a longitudinal direction (e.g., the longitudinal direction D21) of the fixing rotator.

For example, the pair of sealing portions includes a first sealing portion e.g., the sealing portion 40) disposed at a first lateral end of the tube and a second sealing portion (e.g., the sealing portion 40) disposed at a second lateral end of the tube in the longitudinal direction of the fixing rotator. The heat generating portion includes a first lateral end (e.g., the lateral end h1) and a second lateral end (e.g., the lateral end h2) in the longitudinal direction of the fixing rotator.

The first sealing portion includes a first inboard end (e.g., the inboard end 40*a*1) distanced from the first lateral end of the heat generating portion with a first distance (e.g., the distance L1) in the longitudinal direction of the fixing rotator. The second sealing portion includes a second inboard end (e.g., the inboard end 40*a*2) distanced from the second lateral end of the heat generating portion with a second distance (e.g., the distance L2) in the longitudinal direction of the fixing rotator. The first distance is greater than the second distance. In other words, the second distance is smaller than the first distance. The driving force transmitter is disposed in a first lateral end side (e.g., the driving side D1) of the fixing device, that is defined by a center (e.g., the center M) of the fixing rotator in the longitudinal direction of the fixing rotator. The first sealing portion is disposed in the first lateral end side of the fixing device.

Accordingly, the fixing device suppresses temperature increase of the first sealing portion disposed in proximity to the driving force transmitter.

According to the embodiments described above, the fixing belt 21 serves as a fixing rotator. Alternatively, a fixing film, a fixing sleeve, or the like may be used as a fixing rotator. Further, the pressure roller 22 serves as an opposed rotator. Alternatively, a pressure belt or the like may be used as an opposed rotator.

According to the embodiments described above, the image forming apparatus 100 is a printer. Alternatively, the image forming apparatus 100 may be a copier, a facsimile machine, a multifunction peripheral (MIT) having at least two of printing, copying, facsimile, scanning, and plotter functions, an inkjet recording apparatus, or the like.

The above-described embodiments are illustrative and do not limit the present disclosure. Thus, numerous additional modifications and variations are possible in light of the above teachings. For example, elements and features of different illustrative embodiments may be combined with each other and substituted for each other within the scope of the present disclosure.

Any one of the above-described operations may be performed in various other ways, for example, in an order different from the one described above.

What is claimed is:

1. A fixing device comprising:

a fixing rotator;

an opposed rotator configured to contact the fixing rotator to form a nip between the fixing rotator and the opposed rotator;

a heater configured to heat the fixing rotator, the heater including:

a tube;

a heat generating portion disposed inside the tube;

a first sealing portion disposed at a first lateral end of the tube in a longitudinal direction of the fixing rotator, the first sealing portion including a first inboard end distanced from a first lateral end of the heat generating portion with a first distance in the longitudinal direction of the fixing rotator; and a second sealing portion disposed at a second lateral end of the tube in the longitudinal direction of the fixing rotator, the second sealing portion including a second inboard end distanced from a second lateral end of the heat generating portion with a second distance in the longitudinal direction of the fixing rotator, the second distance being smaller than the first distance; and a driving force transmitter configured to transmit a driving force to one of the fixing rotator and the opposed rotator, the driving force transmitter disposed in a first lateral end side of the fixing device, the first lateral end side defined by a center of the fixing rotator in the longitudinal direction of the fixing rotator, the first lateral end side where the first sealing portion is disposed, wherein the heat generating portion is symmetric with respect to the center of the fixing rotator in the longitudinal direction of the fixing rotator.

2. The fixing device according to claim 1,
wherein the first sealing portion is distanced from the center of the fixing rotator in the longitudinal direction of the fixing rotator with a third distance,
wherein the second sealing portion is distanced from the center of the fixing rotator in the longitudinal direction of the fixing rotator with a fourth distance, and
wherein the third distance is greater than the fourth distance.

3. The fixing device according to claim 1, further comprising:
a first side wall disposed at a first lateral end of the fixing device in the longitudinal direction of the fixing rotator; and
a second side wall disposed at a second lateral end of the fixing device in the longitudinal direction of the fixing rotator.

4. The fixing device according to claim 3,
wherein the first inboard end of the first sealing portion is distanced from the first side wall with a fifth distance in the longitudinal direction of the fixing rotator,
wherein the second inboard end of the second sealing portion is distanced from the second side wall with a sixth distance in the longitudinal direction of the fixing rotator, and
wherein the fifth distance is smaller than the sixth distance.

5. The fixing device according to claim 1, further comprising:
a first holder configured to support the fixing rotator at a first lateral end of the fixing rotator in the longitudinal direction of the fixing rotator; and
a second holder configured to support the fixing rotator at a second lateral end of the fixing rotator in the longitudinal direction of the fixing rotator.

6. The fixing device according to claim 5,
wherein the first holder includes a first inboard end in the longitudinal direction of the fixing rotator,
wherein the second holder includes a second inboard end in the longitudinal direction of the fixing rotator,
wherein the first inboard end of the first sealing portion is distanced from the first inboard end of the first holder with a seventh distance in the longitudinal direction of the fixing rotator,
wherein the second inboard end of the second sealing portion is distanced from the second inboard end of the second holder with an eighth distance in the longitudinal direction of the fixing rotator, and
wherein the seventh distance is greater than the eighth distance.

7. The fixing device according to claim 5,
wherein a thermal conductivity of each of the first holder and the second holder is greater than a thermal conductivity of the fixing rotator.

8. The fixing device according to claim 1, further comprising a position restrictor configured to restrict motion of the heater in the longitudinal direction of the fixing rotator.

9. The fixing device according to claim 8,
wherein the position restrictor is made of metal.

10. The fixing device according to claim 1,
wherein the driving force transmitter includes a driving force transmitting gear.

11. The fixing device according to claim 1,
wherein the heat generating portion includes a filament.

12. The fixing device according to claim 1,
wherein the fixing rotator includes an endless belt.

13. The fixing device according to claim 1, wherein the heater includes internal lead wires extending to a centrally located filament, the filament comprising the heat generating portion of the heater.

14. An image forming apparatus comprising:
an image forming device configured to form an image on a recording medium; and
a fixing device configured to fix the image on the recording medium,
the fixing device including:
a fixing rotator;
an opposed rotator configured to contact the fixing rotator to form a nip between the fixing rotator and the opposed rotator;
a heater configured to heat the fixing rotator,
the heater including:
a tube;
a heat generating portion disposed inside the tube;
a first sealing portion disposed at a first lateral end of the tube in a longitudinal direction of the fixing rotator, the first sealing portion including a first inboard end distanced from a first lateral end of the heat generating portion with a first distance in the longitudinal direction of the fixing rotator; and
a second sealing portion disposed at a second lateral end of the tube in the longitudinal direction of the fixing rotator, the second sealing portion including a second inboard end distanced from a second lateral end of the heat generating portion with a second distance in the longitudinal direction of the fixing rotator, the second distance being smaller than the first distance; and
a driving force transmitter configured to transmit a driving force to one of the fixing rotator and the opposed rotator, the driving force transmitter disposed in a first lateral end side of the fixing device, the first lateral end side defined by a center of the fixing rotator in the longitudinal direction of the fixing rotator, the first lateral end side where the first sealing portion is disposed, wherein the heat generating portion is symmetric with respect to the center of the fixing rotator in the longitudinal direction of the fixing rotator.

15. The image forming apparatus according to claim 14, wherein the heater includes internal lead wires extending the first lateral end and the second lateral end of the tube to a centrally located filament, the filament comprising the heat generating portion of the heater.

* * * * *